US006488185B2

(12) United States Patent
Beranger et al.

(10) Patent No.: US 6,488,185 B2
(45) Date of Patent: Dec. 3, 2002

(54) FLUID DISPENSER DEVICE

(75) Inventors: Stéphane Beranger, Surtauville (FR); Firmin Garcia, Evreux (FR)

(73) Assignee: Valois S.A., Le Neubbrug (FR)

( * ) Notice: Subject to any disclaimer, the term of this patent is extended or adjusted under 35 U.S.C. 154(b) by 0 days.

(21) Appl. No.: 09/870,789

(22) Filed: Jun. 1, 2001

(65) Prior Publication Data

US 2002/0003151 A1 Jan. 10, 2002

(30) Foreign Application Priority Data

Jun. 22, 2000 (FR) ..... 00 08034

(51) Int. Cl.[7] ..... B67D 5/00
(52) U.S. Cl. ..... 222/385; 222/321.9
(58) Field of Search ..... 222/321.7, 321.8, 222/321.9, 383.1, 385

(56) References Cited

U.S. PATENT DOCUMENTS 4,139,122 A 2/1979 Bauer
5,348,189 A * 9/1994 Cater ..... 222/385
5,497,915 A 3/1996 Wass ..... 222/153.07
6,036,059 A * 3/2000 VanBrocklin ..... 222/321.9
6,202,896 B1 * 3/2001 Bonningue ..... 222/321.8

OTHER PUBLICATIONS

French Search Report dated Mar. 6, 2001.

* cited by examiner

*Primary Examiner*—J. Casimer Jacyna
(74) *Attorney, Agent, or Firm*—Sughrue Mion, PLLC

(57) ABSTRACT

A fluid dispenser device such as a pump or a valve designed to be fitted to a neck of a receptacle, said device comprising:

a body in which a piston can be caused to slide by depressing a pusher;

a fixing member for fixing the body to the receptacle neck; and a dip tube for bringing the fluid from the receptacle to the body, the dip tube having a free end situated in the vicinity of the bottom of the receptacle and a fixed end held by connection means;

wherein the connection means are formed by the fixing member.

21 Claims, 2 Drawing Sheets

FLUID DISPENSER DEVICE

The present invention relates to a fluid dispenser device such as a pump or a valve designed to be fitted to a neck of a receptacle so as to form a fluid dispenser. Such dispenser devices are in wide use in the fields of perfumes, of cosmetics, or indeed of pharmaceuticals, for dispensing liquid to semi-liquid substances. In general, such a device comprises a body in which a piston can be caused to slide by depressing a pusher, and a fixing member for fixing the body to the neck of the receptacle. A dip tube may also be used to bring the fluid from the receptacle into the body, the dip tube having a free end situated in the vicinity of the bottom of the receptacle and a top end fixed to the dispenser device.

BACKGROUND OF THE INVENTION

In general, the top end of the dip tube is fixed to the body of the device which, for this purpose, forms a connection sleeve in which the end of the dip tube is inserted by force.

Such a device is described in Document U.S. Pat. No. 5,497,915.

OBJECTS AND SUMMARY OF THE INVENTION

An object of the present invention is to propose another solution for fixing the dip tube to the dispenser device.

In the invention, the connection means that make it possible to fix the dip tube to the dispenser device are formed by the fixing member.

Advantageously, the fixing member is in fixing engagement with an inside wall of the receptacle neck. The term "fixing engagement" is used to mean that it is the contact between the fixing member and the inside wall of the neck that fixes the body to the neck. The fixing member is thus extended towards the bottom of the body, preferably by surrounding it with tightly-fitting contact, so that the fixing member forms the connection means at its bottom end. The connection means may advantageously be in the form of a connection sleeve similar to the connection sleeve of a conventional body as in the described prior art.

According to another characteristic of the invention, the fixing member forms an inlet valve seat for a moving inlet valve element.

Advantageously, the inlet valve seat is formed by the connection sleeve.

In another feature of the invention, the body and the fixing member co-operate to form an inlet valve chamber in which a moving valve element is held captive.

According to another characteristic, at least a portion of a delivery channel for delivering the fluid from the body extends between the fixing member and the body.

In addition, the fixing member is provided with snap-fastening means for snap-fastening in the neck.

The invention also provides a fluid dispenser equipped with such a dispenser device.

BRIEF DESCRIPTION OF THE DRAWINGS

The invention is described more fully below with reference to the figures which show an embodiment of the invention by way of non-limiting example, in which.

MORE DETAILED DESCRIPTION

Figure 1:
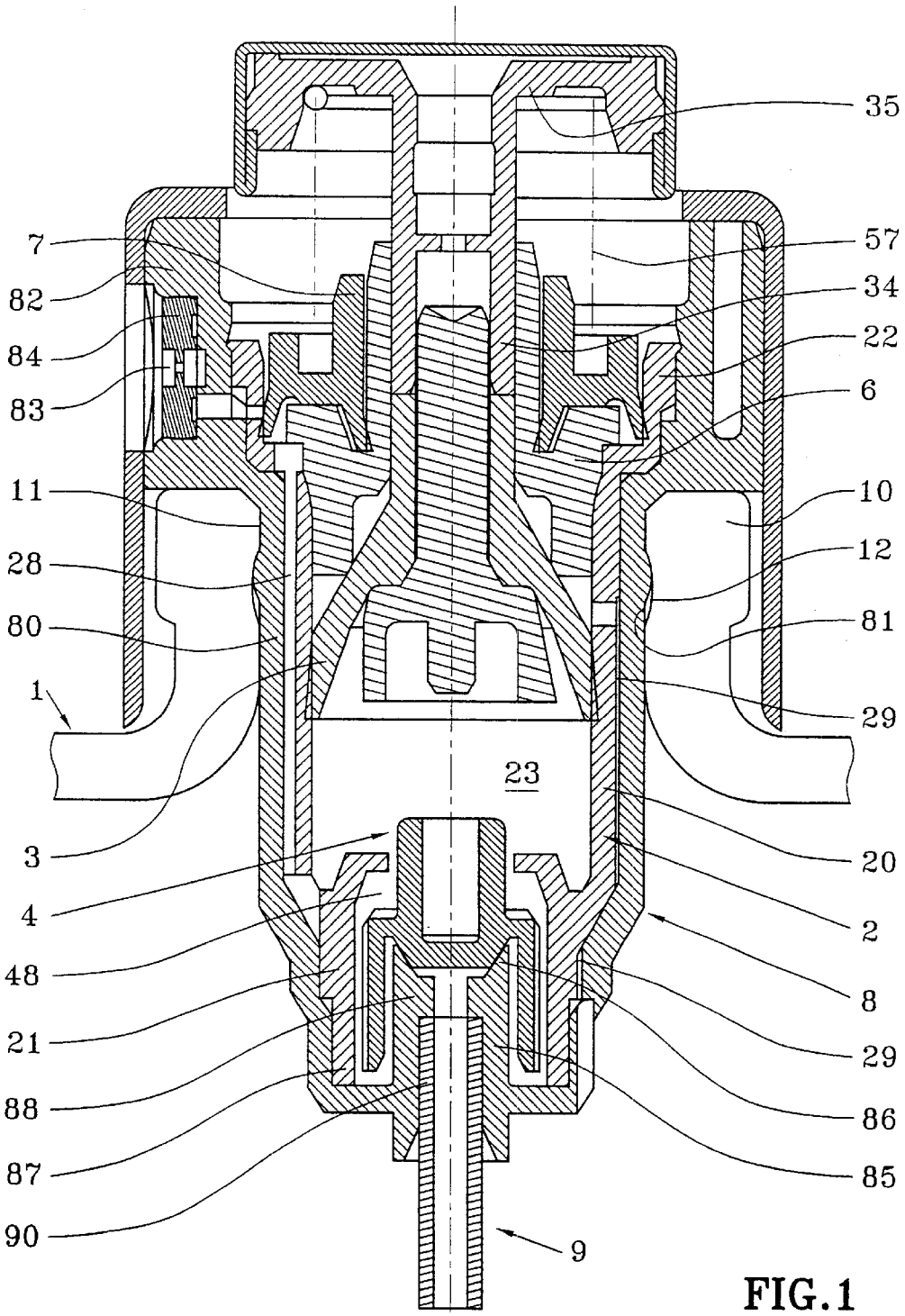
FIG. 1 is a vertical section view through a first embodiment of a fluid dispenser device of the invention as fitted to the neck of a receptacle.

The fluid dispenser used to illustrate the present invention is a pre-compression pump, but it is also possible to use some other pump or even a valve.

The pump shown in the figures is a pump having a fixed spray, i.e. it is provided with a fixed dispensing orifice which does not move when the pump is actuated. This is a particular type of pump, and it would be quite possible to use a pump having a moving spray to illustrate the present invention.

The pump includes a pump body 2 defining a cylindrical portion 20, a collar 22 connected to the top end of the cylindrical portion 20, and a bottom portion 21 connected to the bottom end of the cylindrical portion 20. The pump body 2 is open at both of its ends. A piston 3 is mounted to slide in the pump body 2 at its cylindrical portion 20. The piston 3 is mounted on an actuator rod 34 underlying a pusher 35 that is depressed to displace the piston so that it slides in leaktight manner inside the cylindrical portion 20 of the pump body 2. A return spring 57 urges the piston 3 towards the rest position which defines the maximum volume of the pump chamber 23. In the rest position, as shown in the Figures, the piston 3 bears against a ferrule 6 engaged by force in the pump body 2. The ferrule 6 therefore defines the top dead center of the pump. The ferrule 6 defines a central opening through which the actuator rod 34 slides. The ferrule 6 also serves as an abutment point for a moving high valve member 7 which can move on the ferrule 6. The return spring 57 bears via one of its ends against the underside of the pusher 35 and via its other end against the high moving valve member 7. This is a very unusual design for a pump, and it is possible to consider a more conventional design: e.g. the high valve member may be in the form of a sheath that is free to slide on the actuator rod 34 which defines an internal duct via which the fluid flows from the chamber 23 to reach a dispensing orifice formed in the pusher 35. The high moving valve member 7 is also mounted to slide in the pump body 7 at the collar 22. As it slides, the high moving valve member 7 unmasks an outlet hole that communicates with a nozzle 84 which defines a dispensing orifice 83.

The pump further includes a fixing member 8 that makes it possible to fix the pump body 2 to the neck 10 of a receptacle 1. In this embodiment, the fixing member 8 co-operates with the inside wall 11 of the neck 10. However, it is possible to consider other embodiments, in which the fixing member 8 co-operates with the outside wall of the neck 10. In this embodiment, the fixing member 8 is provided with a skirt 80 whose outside wall is provided with a projection 81 serving to come into engagement in a recess 12 formed in the inside wall 11 of the neck 10. This constitutes snap-fastening fixing which may advantageously be locked by means of the ferrule 6 or of the pump body 2.

The dispenser device of the invention is also provided with a dip tube 9 which is shown in part in the figures. Only the fixed top end 90 of the dip tube 9 is shown. In the invention, the dip tube 9 is fixed to the pump by means of a connection sleeve 85 formed by the fixing member 8. As shown in the figure, the skirt of the fixing member 8 is extended downwards by a bottom portion 87 at the bottom end of which the connection sleeve 85 is formed. The dip tube 9 is inserted by force in the sleeve 85 via its top end 90 until it comes into abutment against a shoulder 88 formed in the connection sleeve.

The pump body 2 is inserted in the fixing member 8 with leaktight tightly-fitting contact at the cylindrical portion 20 and at the bottom portion 21. The pump body 2 is open at its bottom end through which the connection sleeve 85 passes so that the dip tube communicates directly with the inside of the pump chamber 23. In the embodiment shown in FIG. 1, the top end of the sleeve 85 forms an inlet valve seat 86 on which a moving valve element 4 is disposed that can be displaced in limited manner inside a chamber 48 formed jointly by the fixing member 8 and by the bottom portion 21 of the pump body 2. The moving valve member 4 may be in the form of a ball, but it may also be in the form of a molded plastics part as shown in the figures.

Figure 2:
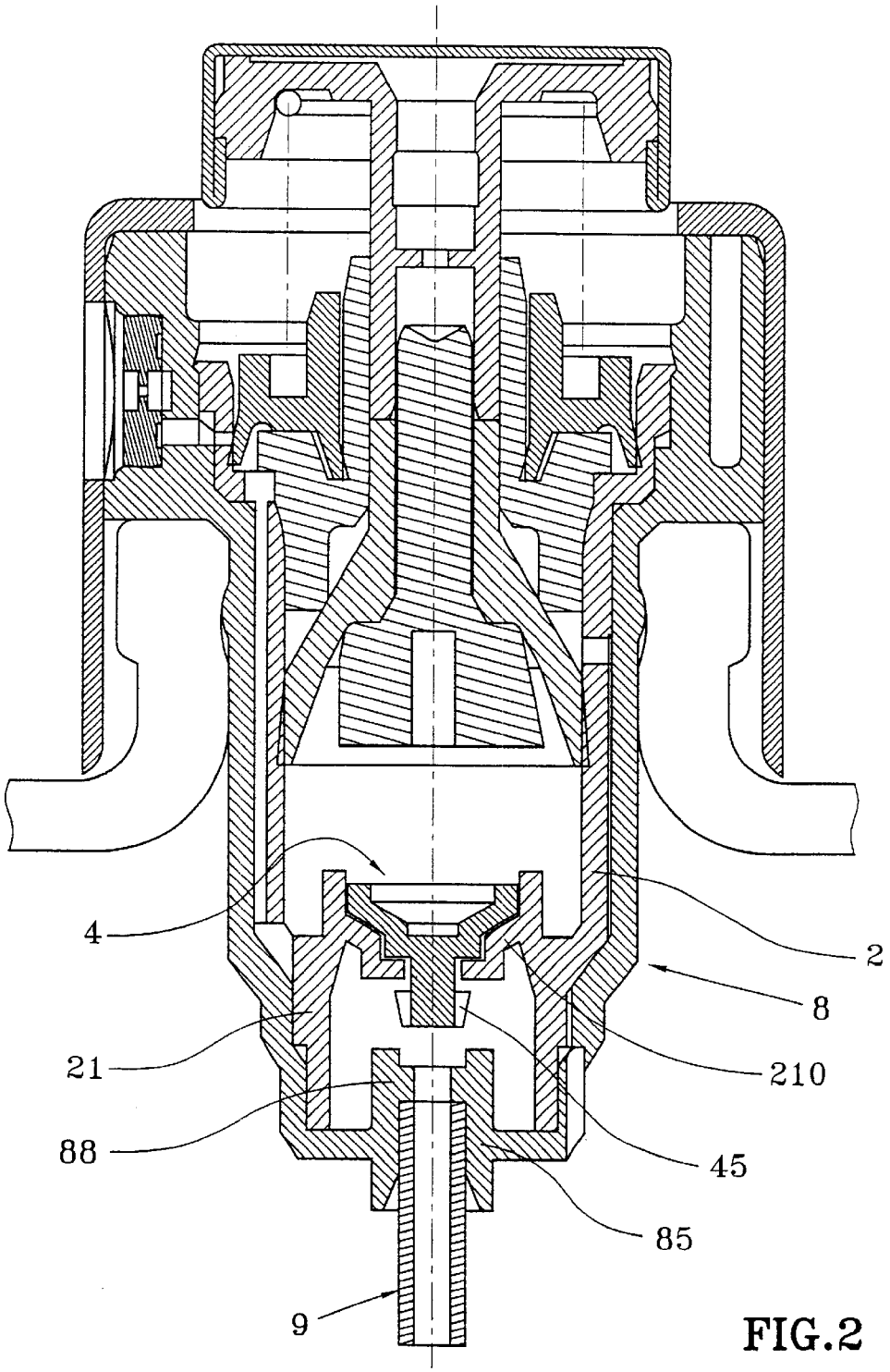
FIG. 2 shows a variant of FIG. 1.

With reference to FIG. 2, it can be seen that the valve seat 210 is formed conventionally by the body 2 of the pump at its bottom portion 21. The moving valve element 4 is held captive in the body which forms a constriction 211 through which the valve member 4 can move in a manner limited by lugs 45.

In the invention, the pump chamber 23 communicates with the nozzle 84 via a delivery channel 28 formed between the pump body 2 at its cylindrical portion 20 and the fixing member 8 at its skirt 80. Isolating the delivery channel 28 is possible because the fixing member 8 is in leaktight tightly-fitting contact with the pump body 2. The fluid delivered by the piston 3 from the chamber 23 passes through the delivery channel 28 to reach the outlet valve element 7 which is then pushed by the fluid under pressure so as to uncover the hole the communicates with the outlet orifice 83.

In addition, an air intake channel 29 is also formed between the fixing member 8 and the pump body 2 to make it possible for the external air to penetrate into the receptacle as the fluid is dispensed by the pump. The air intake channel 29 is formed similarly to the delivery channel 28.

It should also be noted that the nozzle 84 is received in an appendage 82 formed by the fixing member 8.

The fixing member 8 of the present invention thus performs many functions, namely it fixes the body to the neck, it forms connection means for connecting the dip tube, it forms an inlet valve seat, it forms a recess for the nozzle 84, it forms a delivery channel 28, and it forms an air intake channel 29. The number of parts can thus be reduced.

What is claimed is:

1. A fluid dispenser device designed to be fitted to a neck of a receptacle, said device comprising:

a body in which a piston can be caused to slide by depressing a pusher;

a fixing member for fixing the body to the receptacle neck so that the body is immobile with respect to the fixing member; and a dip tube for bringing the fluid from the receptacle to the body, the dip tube having a free end situated in the vicinity of the bottom of the receptacle and a fixed end held by connection means;

wherein the connection means and the fixing member form an integral one-piece construction; and wherein the fixing member is in fixing engagement with an inside wall of the receptacle neck.

2. A fluid dispenser device according to claim 1, in which the fixing member surrounds the body with tightly-fitting contact.

3. A fluid dispenser device according to claim 1, in which the connection means comprise a connection sleeve in which the fixed end of the dip tube is inserted.

4. A fluid dispenser device according to claim 3, in which the fixing member forms an inlet valve seat for a moving inlet valve element, and in which the inlet valve seat is formed by the connection sleeve.

5. A fluid dispenser device according to claim 1, in which the fixing member forms an inlet valve seat for a moving inlet valve element.

6. A fluid dispenser device according to claim 1, in which the body and the fixing member co-operate to form an inlet valve chamber in which a moving valve element is held captive.

7. A fluid dispenser device according to claim 1, in which at least a portion of a delivery channel for delivering the fluid from the body extends between the fixing member and the body.

8. A fluid dispenser device according to claim 1, in which the fixing member is provided with snap-fastening means for snap-fastening in the neck.

9. A fluid dispenser including a dispenser device according to claim 1.

10. A fluid dispenser device designed to be fitted to a neck of a receptacle, said device comprising:

a body in which a piston can be caused to slide by depressing a pusher;

a fixing member for fixing the body to the receptacle neck so that the body is immobile with respect to the fixing member; and a dip tube for bringing the fluid from the receptacle to the body, the dip tube having a free end situated in the vicinity of the bottom of the receptacle and a fixed end held by connection means;

wherein the connection means and the fixing member form an integral one-piece construction; and wherein the fixing member surrounds the body with tightly fitting contact.

11. A fluid dispenser device according to claim 10, in which the fixing member is in fixing engagement with an inside wall of the receptacle neck.

12. The fluid dispenser device according to claim 10, wherein the connection means comprises a connection sleeve in which the fixed end of the dip tube is inserted.

13. A fluid dispenser device designed to be fitted to a neck of a receptacle, said device comprising:

a body in which a piston can be caused to slide by depressing a pusher;

a fixing member for fixing the body to the receptacle neck so that the body is immobile with respect to the fixing member; and a dip tube for bringing the fluid from the receptacle to the body, the dip tube having a free end situated in the vicinity of the bottom of the receptacle and a fixed end held by connection means;

wherein the connection means and the fixing member form an integral one-piece construction; and wherein the fixing member forms an inlet valve seat for a moving inlet valve element.

14. The fluid dispenser device according to claim 13, wherein the connection means comprises a connection sleeve in which the fixed end of the dip tube is inserted.

15. A fluid dispenser device designed to be fitted to a neck of a receptacle, said device comprising:

a body in which a piston can be caused to slide by depressing a pusher;

a fixing member for fixing the body to the receptacle neck so that the body is immobile with respect to the fixing member; and a dip tube for bringing the fluid from the receptacle to the body, the dip tube having a free end situated in the vicinity of the bottom of the receptacle and a fixed end held by connection means;

wherein the connection means and the fixing member form an integral one-piece construction; and wherein the fixing member forms an inlet valve seat for a moving inlet valve element, and wherein the inlet valve seat is formed by the connections means.

16. The fluid dispenser device according to claim 15, wherein the connection means comprises a connection sleeve in which the fixed end of the dip tube is inserted.

17. A fluid dispenser device designed to be fitted to a neck of a receptacle, said device comprising:

a body in which a piston can be caused to slide by depressing a pusher;

a fixing member for fixing the body to the receptacle neck so that the body is immobile with respect to the fixing member; and a dip tube for bringing the fluid from the receptacle to the body, the dip tube having a free end situated in the vicinity of the bottom of the receptacle and a fixed end held by connection means;

wherein the connection means and the fixing member form an integral one-piece construction; and wherein the body and the fixing member co-operate to form an inlet valve chamber in which a moving valve element is held captive.

18. The fluid dispenser device according to claim 17, wherein the connection means comprises a connection sleeve in which the fixed end of the dip tube is inserted.

19. A fluid dispenser device designed to be fitted to a neck of a receptacle, said device comprising:

a body in which a piston can be caused to slide by depressing a pusher;

a fixing member for fixing the body to the receptacle neck so that the body is immobile with respect to the fixing member; and a dip tube for bringing the fluid from the receptacle to the body, the dip tube having a free end situated in the vicinity of the bottom of the receptacle and a fixed end held by connection means;

wherein the connection means and the fixing member form an integral one-piece construction; and wherein at least a portion of a delivery channel for delivering the fluid from the body extends between the fixing member and the body.

20. The fluid dispenser device according to claim 19, wherein the connection means comprises a connection sleeve in which the fixed end of the dip tube is inserted.

21. A fluid dispenser, comprising:

a fluid receptacle having a neck; and a fluid dispensing device fitted to said neck, said fluid dispensing device comprising:

a piston actuated by a pusher;

a body in which said piston slides when said pusher is actuated;

a fixing member that fixes said body to said neck so that said body is immobile with respect to said neck; and a dip tube that brings fluid from said fluid receptacle to said body, said dip tube having a free end in a vicinity of a bottom of said receptacle and a fixed end held within a sleeve;

wherein said sleeve and said fixing member form an integral one-piece construction;

wherein said fixing member is secured to said body so that said body is immobile with respect to said fixing member; and wherein said fixing member is in snap-fastened engagement with an inside wall of said neck.

* * * * *